US006386900B2

(12) United States Patent
Hio et al.

(10) Patent No.: US 6,386,900 B2
(45) Date of Patent: May 14, 2002

(54) INSULATION-DISPLACEMENT TERMINAL FITTING

(75) Inventors: Masahide Hio; Eiji Kojima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/893,918

(22) Filed: Jun. 28, 2001

(30) Foreign Application Priority Data

Jun. 28, 2000 (JP) ..... 2000-194096

(51) Int. Cl.[7] ..... H01R 4/24

(52) U.S. Cl. ..... 439/406; 439/407; 439/399; 439/397; 439/401

(58) Field of Search ..... 439/397, 398, 439/399, 400, 401, 406, 407

(56) References Cited

U.S. PATENT DOCUMENTS 4,427,251 A * 1/1984 Mathe et al. ..... 439/397
6,012,942 A * 1/2000 Volstorf ..... 439/397

FOREIGN PATENT DOCUMENTS

EP 0 352 966 B1 10/1993
JP 57-10550 2/1982

* cited by examiner

*Primary Examiner*—Tho D. Ta
(74) *Attorney, Agent, or Firm*—Gerald E. Hespos; Anthony J. Casella

(57) ABSTRACT

An insulation-displacement terminal has opposed side walls (12) and a wire-receiving space therebetween. V-shaped insulation-displacement portions (16) are formed by a pair of plates (16F, 16R) that are bent from the side walls (12) and project into the wire-receiving space. A bending angle (β) between one plate (16R) and the side wall (12) is larger than a bending angle (α) between the other plate (16F) and the side wall (12). A pulling force on the wire (W) does not make a loose movement since the bending angle of the plate (16F) located at the side behind with respect to a pulling direction is a right angle. Further, since the bending angle (β) between the plate (16R) and the side wall 12 is larger, an angle (γ) between the plates (16F) and (16R) of the insulation-displacement portion (16) is sufficiently large to ensure a wide contact area with a core (Wb) of the wire (W). Thus, a high contact reliability can be secured.

14 Claims, 4 Drawing Sheets

INSULATION-DISPLACEMENT TERMINAL FITTING

BACKGROUND OF THE INVENTION

1. Field of the Invention

The present invention relates to an insulation-displacement terminal fitting.

2. Description of the Related Art

Japanese Examined Patent Publication No. 57-10550 discloses an insulation-displacement terminal fitting with opposed left and right side walls and a wire-receiving space therebetween. Portions of the respective side walls are bent to define V-shaped insulation-displacement portions that project into the wire-receiving space. A wire can be pushed into the wire-receiving space in a direction normal to the longitudinal direction of the wire. As a result, an insulation coating of the wire is cut open by projecting ends of the insulation-displacement portions and a core of the wire is brought into contact with the projecting ends of the insulation-displacement portions.

The contact area between the insulation-displacement portions and the core is increased and the contact reliability is better as the angle at the projecting ends of each V-shaped insulation-displacement portion increases. However, a pulling force may be exerted on the wire in its longitudinal direction, and such a pulling force may cause a loose movement of the wire. The ability of the wire to resist such a pulling force is greater when the angle of the insulation-displacement portion to the cut surface of the resin coating becomes closer to a right angle with respect to the pulling direction and when the angle at the projecting ends of the V-shaped insulation-displacement portions is smaller.

Typically these competing objectives of achieving contact reliability with the core and restricting loose movement of the wire has required one of these objectives to be compromised so that the other objective can be achieved more effectively.

In view of the above, an object of the invention is to improve contact reliability with a core and to restrict loose movement of a wire.

SUMMARY OF THE INVENTION

The invention is directed to an insulation-displacement terminal fitting having opposed first and second side walls and a wire-receiving space therebetween. First and second insulation-displacement portions project inwardly from the respective side walls. A wire may be oriented substantially parallel to the respective side walls and may be pushed substantially normal to the longitudinal direction of the wire into the wire-receiving space between the insulation-displacement portions. Thus, a resin coating of the wire is cut open by projecting ends of the insulation-displacement portions, and a core of the wire is brought into contact with the projecting ends of the insulation-displacement portion. Each insulation-displacement portion is formed by first and second plates that are bent from the corresponding side wall to project substantially in a V-shape into the wire-receiving space. The bending angle between at least one of the plates of the first of the insulation-displacement portion and the first side wall is set larger than a bending angle between the plates of the second insulation-displacement portion and the second side wall. Additionally, the two plates of one of the insulation-displacement portions are bent from the corresponding side wall to define different bending angles on that insulation displacement portion.

One plate of at least one insulation-displacement portion may be at a right angle to the corresponding side wall. Additionally or alternatively, one plate of at least one insulation-displacement portion may be at an acute angle to the corresponding side wall.

An external pulling force could be exerted on the wire in a direction that would loosely move the wire in its longitudinal direction. Effective loose movement restriction can be obtained by setting the plate that faces away from the direction of the pulling force at close to a right angle with respect to the side wall. The plate that faces in the same direction as the pulling force on the wire then can be set at a large angle, i.e. at an obtuse angle, with respect to the side wall. Accordingly, a bending angle between the plates of the insulation-displacement portion is large, and a wide contact area with the core is achieved.

The plate that faces away from the direction of the pulling force on the wire is at close to a right angle to the side wall. Thus, that plate is engaged with a cut surface of the resin coating is aligned in a direction normal to the direction of loose movement, and a high loose movement restricting effect can be obtained.

The plate that faces away from the direction of the pulling force on the wire also may be at an acute angle to the side wall, and hence bites in the resin coating like a wedge. Thus, a high loose movement restricting effect can be obtained.

DETAILED DESCRIPTION OF THE PREFERRED EMBODIMENTS

Figure 1:
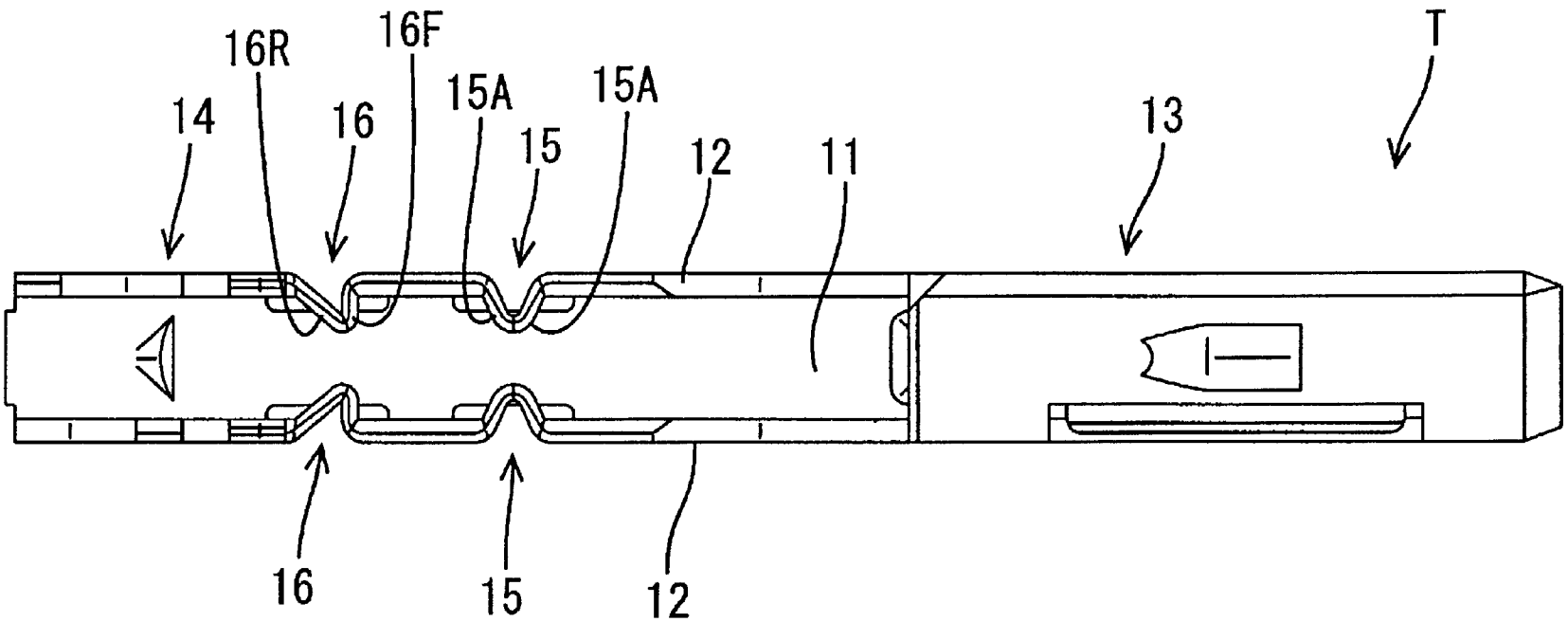
FIG. 1 is a top plan view of a terminal fitting in accordance with the subject invention.
Figure 2:
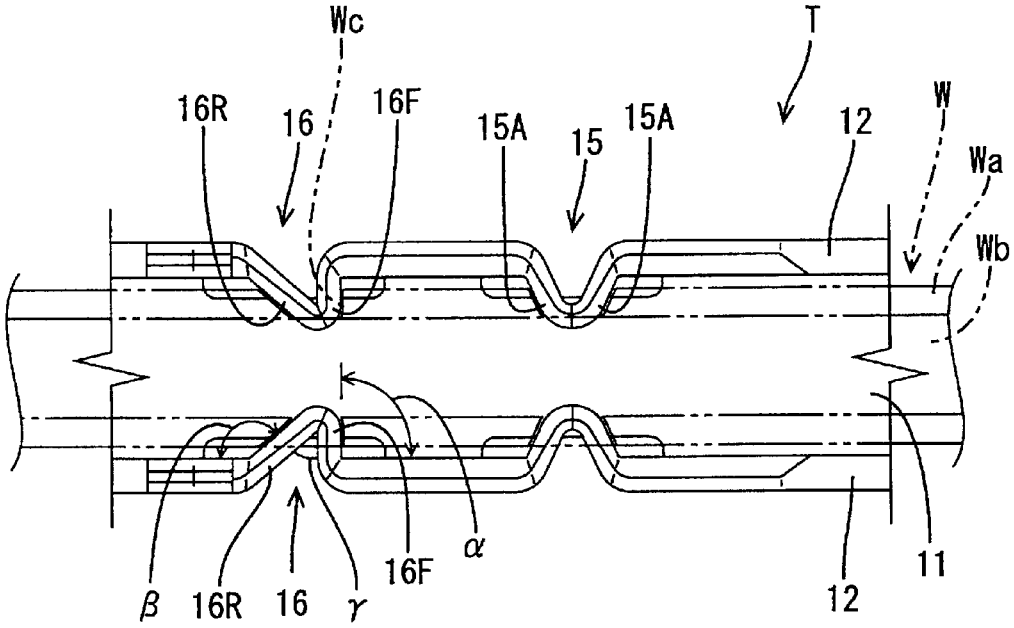
FIG. 2 is an enlarged top plan view of the insulation-displacement portions of the terminal fitting shown in FIG. 1.

An insulation-displacement terminal fitting according to a first embodiment of the invention is identified by the letter T in FIGS. 1 and 2, and is produced by bending a conductive metal plate that has been stamped into a specified shape. The insulation-displacement terminal fitting T is narrow in forward and backward directions, and comprises a bottom wall 11 with opposite side edges. Two side walls 12 extend up from the opposite side edges of the bottom wall 11 over its entire length.

An engaging portion 13 is formed at the front half of the terminal fitting T, and defines a rectangular tube configured for connection with a mating male terminal fitting (not shown). A crimping portion 14 is formed at the rear end of the terminal fitting T and is configured for crimped connection with a wire W.

Insulation-displacement portions 15, 16 project from the side walls 12 at locations between the engaging portion 13 and the crimping portion 14. The insulation-displacement portions 15, 16 comprise a pair of front insulation displacement portions 15 and a pair of rear insulation displacement portions 16. Thus, a total of four insulation-displacement portions are formed. The insulation-displacement portions 15, 16 in each pair are substantially opposed to one another to hold the wire in a wire-receiving space between the insulation-displacement portions 15 or 16 of the respective pair.

The respective insulation-displacement portions 15, 16 are formed by bending portions of the side walls 12 to project inwardly substantially in V-shape. Thus, substantially flat plates 15A or 16F and 16R extend obliquely from the side walls 12 and are joined.

Each insulation-displacement portion 15 in the front pair has a shape of an isosceles triangle in which the front and rear plates 15A are symmetrical. Specifically, the angle between the side wall 12 and the front plate 15A is the same as the angle between the side wall 12 and the rear plate 15A, and both angles are substantially equal to 120°. Accordingly the angle between the projecting ends of the plates 15A is about 60°. Further, the insulation-displacement portions 15 are symmetrical with respect to a center longitudinal axis of the terminal fitting T in plan view.

Each insulation-displacement portion 16 in the rear pair has a shape of a substantially right triangle in which the front and rear plates 16F, 16R of the insulation-displacement portions 16 are asymmetrical. Specifically, the angle a between the front plate 16F and the side wall 12 is substantially a right angle, but the angle β between the rear plate 16R and the side wall 12 is an obtuse angle. An angle γ between the plates 16F, 16R is about 45°. The rear insulation-displacement portions 16 also are symmetrical with respect to the center longitudinal axis of the terminal fitting T in plan view.

The terminal fitting T of the first embodiment is used by first orienting the wire W with its longitudinal axis oriented in forward and backward directions (parallel to the longitudinal direction of the terminal fitting T and the side walls 12). The wire W then is pushed between the side walls 12 of the insulation-displacement terminal fitting T in a direction normal to the longitudinal axis of the wire W. As the wire W is pushed in, the projecting ends of the substantially V-shaped insulation-displacement portions 15, 16 cut open the resin coating Wa of the wire W between the respective pairs of the insulation-displacement portions 15, 16, and bite in the cut-open sections of the resin coating Wa to contact the core Wb. As a result, the wire W is connected with the respective insulation-displacement portions 15, 16 by insulation displacement.

Wide contact areas are provided between the rear insulation-displacement portions 16 and the core Wb because the angle at the projecting ends of the rear insulation-displacement portions 16 is a relatively large angle of 45°. As a result, a sufficient contact reliability is achieved between the rear insulation displacement portions 16 and the core Wb of the wire W. Further, the front plates 16F of the rear insulation-displacement portions 16 project substantially at a right angle to the side walls 12, and contact cut surfaces Wc of the resin coating Wa of the wire W by engaging the corresponding surfaces Wc substantially normal to the longitudinal axis of the wire W. Thus, the engagement of the plates 16F and the cut surfaces Wc prevent a loose backward movement even if a rearward pulling force is exerted on the wire W.

A strong engagement to restrict the loose movement of the wire W in its longitudinal direction is achieved by making the front plates 16F substantially at a right angle to the side walls 12. Simultaneously, the angle γ between the plates 16F and 16R is increased by setting the angle β between the rear plates 16R and the side walls 12 at an obtuse angle. Thus, contact reliability with the core Wb is improved.

Figure 3:
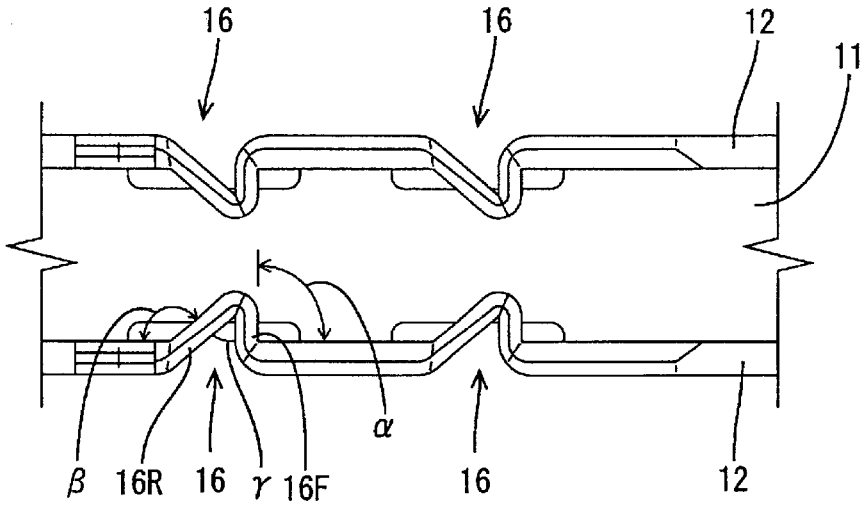
FIG. 3 is a top plan view similar to FIG. 2, but showing a second embodiment.

A second embodiment of the invention is described with reference to FIG. 3, and has front and rear pairs of Insulation-displacement portions 16 substantially as in the first embodiment. Each of the four insulation-displacement portions 16 shown in FIG. 3 is substantially in the form of a right triangle. Specifically, front and rear plates 16F and 16R of each insulation-displacement portion 16 are asymmetrical. The angle a between the front plate 16F and the side wall 12 is substantially a right angle, but the angle β between the rear plate 16R and the side wall 12 is an obtuse angle. The angle γ between the plates 16F, 16R is about 45°. Other elements of the second embodiment are substantially the same as in the first embodiment, and the similar elements merely are identified by the same reference numerals as in the first embodiment.

Figure 4:
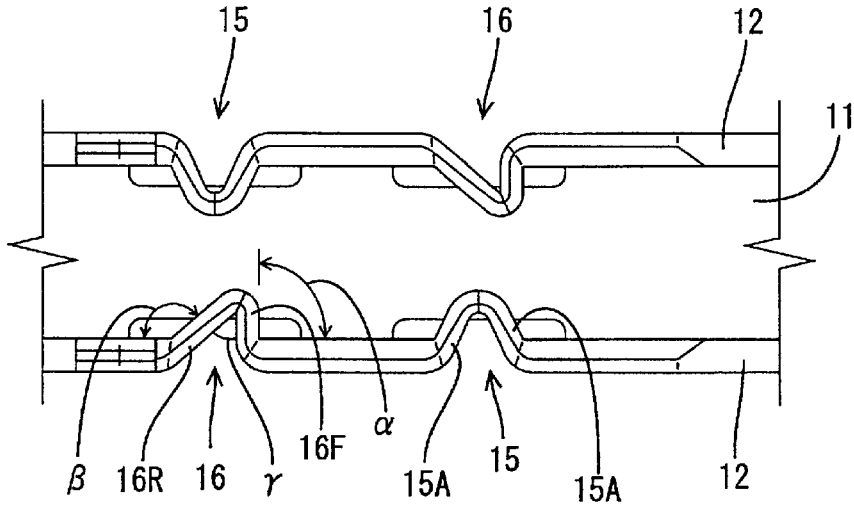
FIG. 4 is a top plan view similar to FIGS. 2 and 3, but showing a third embodiment.

A third embodiment of the invention is described with reference to FIG. 4, and has front and rear pairs of Insulation-displacement portions 15, 16 substantially as in the first embodiment. However, the right front insulation-displacement portion 15 and the left rear insulation-displacement portions 15 each are in the form of an isosceles triangle. Thus, the front and rear plates 15A of the right front and the left rear insulation displacement portions 15 are symmetrical. On the other hand, the left front insulation-displacement portion 16 and the right rear insulation-displacement portion 16 are substantially in the form of a right triangle. Thus, the front and rear plates 16F, 16R of the left front and the right rear insulation-displacement portions 16 are asymmetrical and the front plate 16F is substantially at a right angle to both the side wall 12 and the longitudinal axis of the wire. In this way, the insulation-displacement portions 15 in the form of an isosceles triangle and the insulation-displacement portions 16 in the form of a right triangle are offset from each other with respect to forward and backward directions and transverse direction in the third embodiment.

Figure 5:
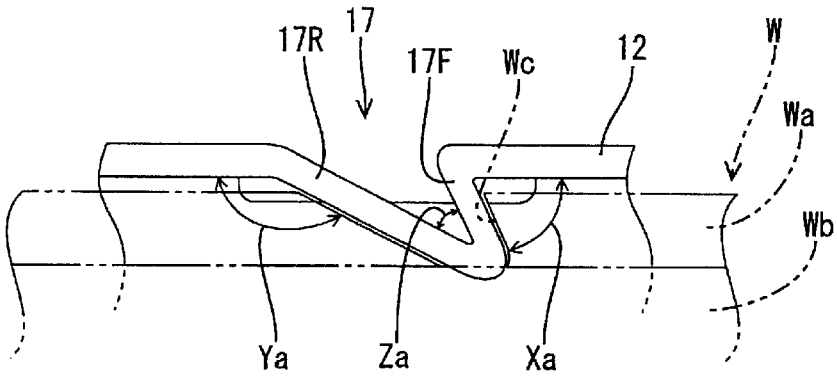
FIG. 5 is a top plan view of a fourth embodiment.

A fourth embodiment of the invention is described with reference to FIG. 5, and has an insulation-displacement portion 17 formed by front and rear plates 17F, 17R. The front plate 17F of the insulation-displacement portion 17 is aligned to the side wail 12 at an acute angle Xa. However, the rear plate portion 17R of the insulation-displacement portion 17 is aligned to the side wall 12 at an obtuse angle Ya which is larger than the obtuse angle β between the side wall 12 and the rear plate 16R of the above-described insulation-displacement portion 16. Consequently, an angle Za between the plates 17F and 17R is relatively large, and is substantially equal to the angle y between the plates 16F and 16R of the insulation-displacement portion 16.

According to the fourth embodiment, a backward pulling force on the wire W causes the front plate 17F to contact the cut surface Wc of the resin coating Wa obliquely, and hence the front plate 17F bites in the core Wb like a wedge. Therefore, a higher loose movement restricting effect can be obtained.

Figure 6:
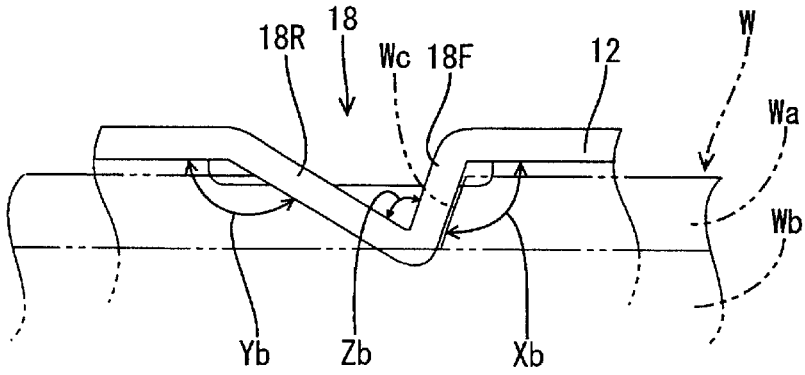
FIG. 6 is a top plan view of a sixth embodiment.

A fifth embodiment of the invention is described with reference to FIG. 6, and has an insulation-displacement portion 18 formed by front and rear plates 18F, 18R, each of which is aligned to the side wall 12 at obtuse angle. However, the angle Yb between the rear plate 18R and the side wall 12 is larger than the angle Xb between the front plate 18F and the side wall 12. As a result, the plate 18F and the cut surface Wc of the resin coating Wa are engaged in a direction substantially normal to the longitudinal direction of the wire W when a pulling force acts on the wire W. Thus, effective restriction on loose movement of the wire W can be achieved. Further, a better contact reliability with the core Wb can be ensured because the front plate 18F is at an obtuse angle to the side wall 12 and ensures a sufficiently large angle Zb between the front and rear plates 18F and 18R.

The present invention is not limited to the above described and illustrated embodiment. For example, the following embodiment also is embraced by the technical scope of the present invention. Beside the following embodiment, various changes can be made without departing the sprit of the present invention.

In the foregoing embodiment, the plate aligned to the side wall at the smaller angle is at the side behind with respect to the pulling direction (front side of the terminal fitting) based on the assumption that the wire is subjected to a pulling force to withdraw the wire backward from the insulation-displacement terminal fitting. However, according to the present invention, the plate aligned to the side wall at the smaller angle may be at the side behind with respect to a pushing direction (rear side of the terminal fitting) for a situation the wire is subjected to an external pushing force.

What is claimed is:

1. An insulation-displacement terminal fitting for use with a wire (W) having a core (Wb) and an resin coating (Wa) surrounding the core (Wb), the insulation-displacement terminal fitting having opposed first and second side walls (12) and a wire-receiving space therebetween, first and second substantially V-shaped insulation-displacement portions (16; 17; 18) projecting from the respective first and second side walls (12) and into the wire-receiving space, each said insulation-displacement portion (16; 17; 18) being formed by first and second plates (16F, 16R; 17F, 17R; 18F, 18R) bent from the respective side wall (12) at a selected bending angle and meeting at a projecting end of the respective insulation-displacement portion (16; 17; 18), the bending angle of the first plate (16F; 17F; 18F) of at least the first insulation-displacement portion (16; 17; 18) to the first side wall (12) being different from the bending angle of the second plate (16R; 17R; 18R) of the first insulation-displacement portion (16; 17; 18) to the first side-wall (12), wherein insertion of the wire (W) transversely into the wire-receiving space causes the projecting ends of the insulation-displacement portions (16; 17; 18) to cut the resin coating (Wa) of the wire (W) and contact the core (Wb) of the wire (W).

2. The insulation-displacement terminal fitting of claim 1, wherein the first and second insulation-displacement portions (16) define a first pair of opposed insulation-displacement portions (16), the insulation-displacement terminal fitting further comprising a second pair of opposed V-shaped insulation-displacement portions (18) comprising third and fourth insulation-displacement portions (18), each of the third and fourth insulation displacement portions (18) being defined by first and second plates (18F, 18R), the first plate (18F) of at least one insulation displacement portion (18) being aligned to the respective side wall (12) at an angle different from the alignment of the second plate (18R) thereof.

3. The insulation-displacement terminal fitting of claim 1, wherein the first plate (16F) of first insulation-displacement portion (16) is bent at a right angle bending angle to the corresponding side wall (12).

4. The insulation-displacement terminal fitting of claim 3, wherein the second plate (16R) of the first insulation-displacement portion (16) is aligned to the first side wall (12) at an obtuse angle.

5. The insulation-displacement terminal fitting of claim 1, wherein the first plate (17F) of first insulation-displacement portion (17) is bent at an acute angle to the corresponding side wall (12).

6. The insulation-displacement terminal fitting of claim 5, wherein the first and second plates (15A) of the second insulation-displacement portion (15) are aligned at equal angles to the second side wall (12).

7. The insulation-displacement terminal fitting of claim 6, wherein the first and second plates (15A) of the second insulation-displacement portion (15) are aligned to the second side wall (12) at an angle of substantially 60 degrees.

8. An insulation-displacement terminal fitting comprising an elongate bottom wall (11) with opposite front and rear ends, first and second side walls (12) projecting up from the bottom wall (11) and defining a wire-receiving space therebetween, first and second front insulations-displacement portions (15) formed respectively at opposed locations on the first and second side walls (12) and projecting into the wire receiving space, first and second rear insulation-displacement portions (16; 17) formed respectively at opposed locations on the first and second side walls (12) and at a longitudinal position between the front insulation displacement portions (15) and the rear end of the terminal fitting, each of said front and rear insulation displacement portions (15; 16; 17) being substantially V-shaped and comprising front and rear panels (15A; 16F, 16R; 17F, 17R) meeting in said wire-receiving space, the rear panel (15A; 16R; 17R) of each said insulation-displacement portion (15; 16; 17) extending from a location on the respective side wall (12) closer to the rear end of the terminal fitting than front panel (15A; 16F; 17F) thereof, the front panel (16F; 17F) of one insulation-displacement portion (16; 17) on each said side wall (12) being aligned to the respective side wall at a bending angle of no more than substantially 90 degrees.

9. The insulation-displacement terminal fitting of claim 8, wherein the bending angle is substantially 90 degrees.

10. The insulation-displacement terminal fitting of claim 8, wherein the bending angle is an acute angle.

11. The insulation-displacement terminal fitting of claim 8 wherein the front panel (15A; 16F; 17F) of each said insulation displacement terminal fitting is aligned to the respective side wall (12) at an acute angle.

12. The insulation-displacement terminal fitting of claim 8, wherein the front and rear panels (15A; 16F; 17, 16R) of each said insulation-displacement portion intersect one another at an angle of at least 45 degrees.

13. The insulation-displacement terminal fitting of claim 8 wherein the rear panels (16R) that are aligned to the respective side walls (12) at no more than substantially 90 degrees are substantially opposed to one another.

14. The insulation-displacement terminal fitting of claim 8, wherein one of the rear panels (16R) that is aligned to the respective side wall (12) at no more than substantially 90 degrees is on the first front insulation-displacement portion (16), and wherein the other of the rear panels (16R) that is aligned to the respective side wall (12) at no more than substantially 90 degrees is on the second rear insulation-displacement portion (16).

* * * * *